US005718143A

United States Patent [19]

Clowes

[11] Patent Number: 5,718,143

[45] Date of Patent: Feb. 17, 1998

[54] METHOD AND APPARATUS FOR FORMING CONTAINER END HAVING ANNULAR PANEL WITH NON-UNIFORM RADIUS OF CURVATURE

[75] Inventor: Ernest J. Clowes, Westmoreland, Pa.

[73] Assignee: Metal Container Corporation, St. Louis, Mo.

[21] Appl. No.: 754,775

[22] Filed: Nov. 21, 1996

Related U.S. Application Data

[62] Division of Ser. No. 342,737, Nov. 21, 1994, Pat. No. 5,645,189.

[51] Int. Cl.[6] ..... B21D 22/00; B21D 22/21; B21C 37/02

[52] U.S. Cl. ..... 72/348; 72/379.2; 72/352; 413/8

[58] Field of Search ..... 72/347, 348, 349, 72/350, 351, 352, 356, 379.4; 413/2, 4, 8, 56

[56] References Cited

U.S. PATENT DOCUMENTS

| | | | |
|---|---|---|---|
| 1,890,936 | 12/1932 | Douglass . | |
| 3,774,801 | 11/1973 | Gedde . | |
| 3,843,014 | 10/1974 | Cospen et al. . | |
| 3,912,113 | 10/1975 | Peyser et al. . | |
| 4,031,837 | 6/1977 | Jordan . | |
| 4,109,599 | 8/1978 | Schultz . | |
| 4,134,354 | 1/1979 | Cvacho et al. . | |
| 4,722,215 | 2/1988 | Taube et al. . | |
| 4,796,772 | 1/1989 | Nguyen | 220/66 |
| 4,808,052 | 2/1989 | Bulso, Jr. et al. . | |
| 4,809,861 | 3/1989 | Wilkenson et al. | 220/66 |
| 4,956,906 | 9/1990 | Masse et al. . | |
| 5,014,536 | 5/1991 | Saunders . | |
| 5,049,019 | 9/1991 | Franek et al. . | |
| 5,052,207 | 10/1991 | Porucznik . | |
| 5,095,733 | 3/1992 | Porucznik, et al. . | |
| 5,168,742 | 12/1992 | Heyes et al. . | |
| 5,181,409 | 1/1993 | Heyes et al. . | |
| 5,209,099 | 5/1993 | Saunders . | |

OTHER PUBLICATIONS

Hosford et al., "the Aluminum Beverage Can," *Scientific American*, Sep. 1994, pp. 48–53.

*Primary Examiner*—Lowell A. Larson
*Assistant Examiner*—Redney Butler
*Attorney, Agent, or Firm*—Sidley & Austin

[57] ABSTRACT

A container end, including a die and the method for making, for pressurized containers includes a circular center panel, an inner annular panel around the center panel, and an outer annular panel around the inner annular panel. The inner annular panel has a generally arcuate cross-section viewed in a plane extending radially from the centerpoint of the container lid. The inner annular panel comprises a plurality of first segments, spaced apart about the circumference of the inner annular panel, and a plurality of second segments, with at least one second segment being positioned between adjacent pairs of first segments. The radius of curvature of the arcuate cross section of each of the first segments is less than the radius of curvature of the arcuate cross section of each of the second segments, so that the radius of curvature of the inner annular panel varies along the circumferential length of the inner annular panel.

15 Claims, 8 Drawing Sheets

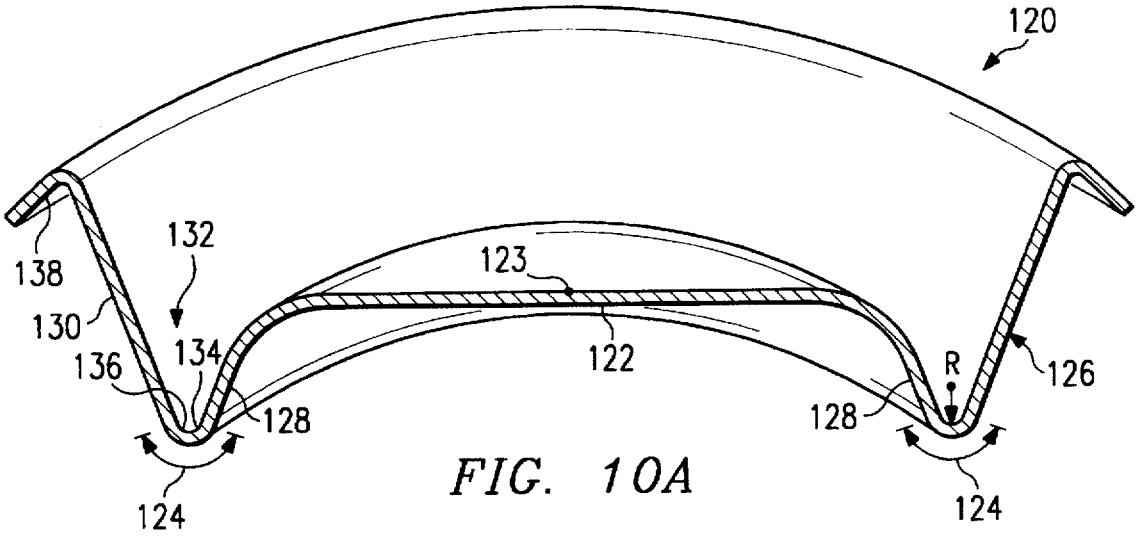
FIG. 10A
FIG. 10B
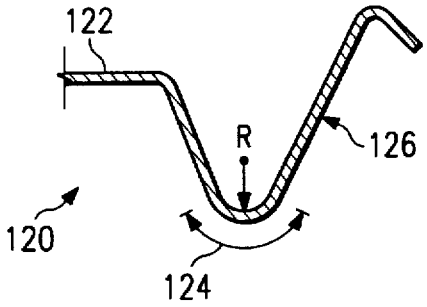
FIG. 10C
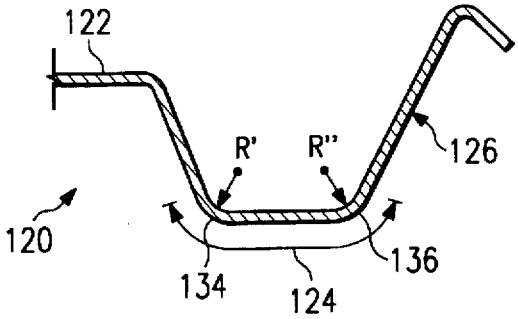
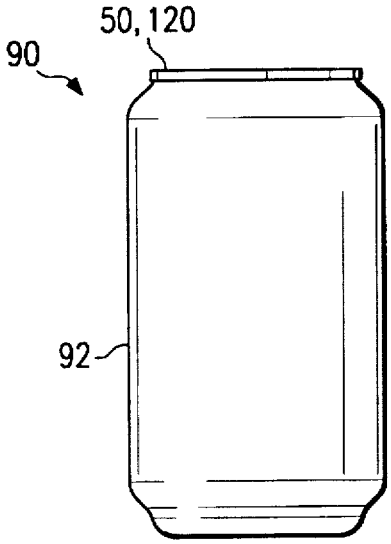
FIG. 11

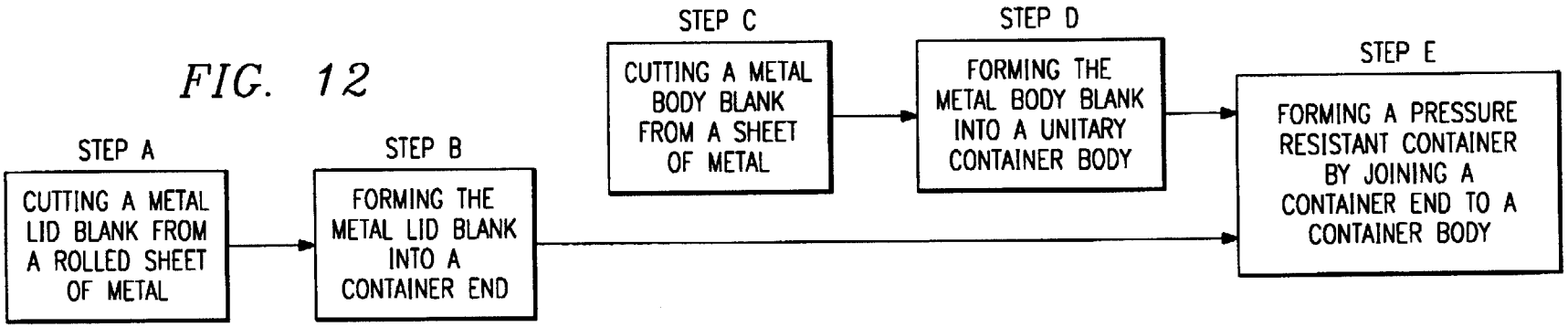
FIG. 12
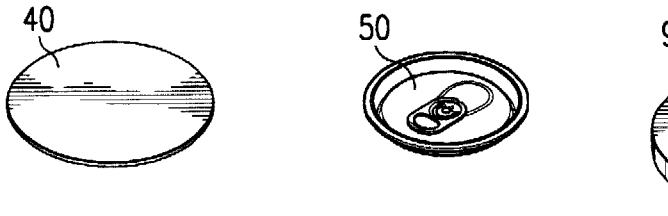
FIG. 13A
FIG. 13B
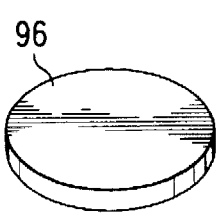
FIG. 13C
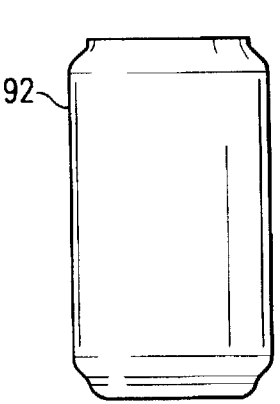
FIG. 13D
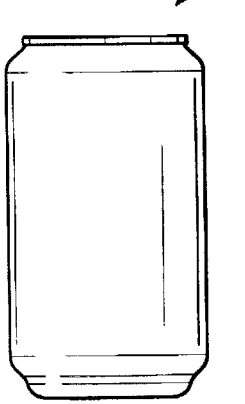
FIG. 13E

METHOD AND APPARATUS FOR FORMING CONTAINER END HAVING ANNULAR PANEL WITH NON-UNIFORM RADIUS OF CURVATURE

CROSS REFERENCE TO RELATED APPLICATIONS

This is a division of U.S. patent application Ser. No. 08/342,737 filed Nov. 21, 1994 now U.S. Pat. No. 5,645,189.

TECHNICAL FIELD OF THE INVENTION

The present invention relates to a container end formed from a metal sheet and having an annular curved surface for increasing the strength of the container end, a container provided with such an end, and a die for forming the container end.

BACKGROUND OF THE INVENTION

The construction of container ends drawn or formed from a metal sheet for use with metal containers are well-known in the prior art. Because of the high volume and the competitiveness in the industry for metal containers, there is a continuing search for improvements in the construction of containers and container ends which provide improved capabilities as well as improvements which provide a cost reduction, e.g., provide the desired construction or capabilities while employing a smaller amount of the metal.

Presently, container lids are produced by drawing or forming a flat, circular metal blank into a lid having a center panel, an annular groove, and an annular seaming panel. The annular groove is defined by an inner annular wall and an outer annular wall, with the top of the outer annular wall being joined to the annular seaming panel, the top of the inner annular wall being joined to the center panel by a panel radius portion, and the bottoms of the two annular walls being joined together by at least one bottom radius portion.

Jordan, U.S. Pat. No. 4,031,837, increases the strength of a conventional container lid by providing for a small radius of curvature in the bottom radius portion of the annular groove, which is uniform about the circumference of the annular groove. However, a disadvantage of an annular panel portion having a small radius of curvature is that the container lid is more prone to fracture, while a container lid having a larger radius of curvature is more prone to deformation caused by the pressure of the contents of the container. Therefore, a smaller radius of curvature strengthens the container lid against deformation but also subjects the lid to increased susceptibility to fracture.

Similar to strengthening the lid by providing for a smaller radius of curvature at the bottom of the annular groove, a container end can be strengthened by reducing the radius of curvature of the joinder of the center panel and the inner annular wall. This may make the inner annular wall more nearly vertical. However, the smaller radius of curvature of the joinder of the center panel and the inner annular panel also leads to an increased likelihood of metal fracturing at this joinder.

The metal blanks used to construct the container ends are produced in a blanking operation wherein metal blanks are cut from a sheet of metal. The nature of the rolling process used to fabricate the metal sheet used to produce the lids causes the physical properties of the metal sheet to vary at different locations depending on the angle from the rolling direction of the metal sheet. Because of the alignment of the grains of the metal in the sheet, the sheet is anisotropic, i.e., the tensile and shear strength of the sheet metal are not the same in all directions. However, the operation of forming a circular groove in a circular container end involves the application of forces along radial lines throughout the circumference of the groove. Hence, certain locations on the end blank are more likely to buckle (because of less structural rigidity) or fracture due to the orientation of that site on the end blank with respect to the rolling direction of the sheet from which the end blank is formed.

Thus, there is a need for a container end having a structure which takes into account differences in characteristics of the metal at different locations on the end blank with respect to the rolling direction. Additionally, there is a need for a die to produce the new container end.

SUMMARY OF THE INVENTION

The present invention provides a new and improved container end comprising a center panel, an inner annular panel and an outer annular panel. The outer periphery of the center panel is joined to the inner periphery of the inner annular panel, and the outer periphery of the inner annular panel is joined to the inner periphery of the outer annular panel. The inner annular panel has a generally arcuate shaped cross section when viewed in a radial plane from the centerpoint of the lid. The inner annular panel comprises a plurality of segments delineated by radii from the centerpoint of the lid, wherein the radius of curvature of the generally arcuate shaped cross sections of these segments is non-uniform or variable along the circumference of the inner annular panel. This construction provides increased structural strength and decreased likelihood of cracking or fracture.

BRIEF DESCRIPTION OF THE DRAWINGS

FIG. 10A is an enlarged vertical cross-sectional view of an alternative embodiment of a container lid of the present invention.

FIG. 10B is a fragmentary cross-sectional view of one embodiment of the container lid shown in FIG. 10A.

FIG. 10C is a fragmentary cross-sectional view of a second embodiment of the container lid shown in FIG. 10A.

FIG. 11 is a front view of a container having a container lid and a container body.

FIG. 12 shows the steps for producing the container end of the present invention as part of the steps for producing a container.

FIG. 13A illustrates a metal lid blank.

FIG. 13B illustrates a container lid.

FIG. 13C illustrates a metal body blank.

FIG. 13D illustrates a container body.

FIG. 13E illustrates a container.

DETAILED DESCRIPTION

Figure 1:
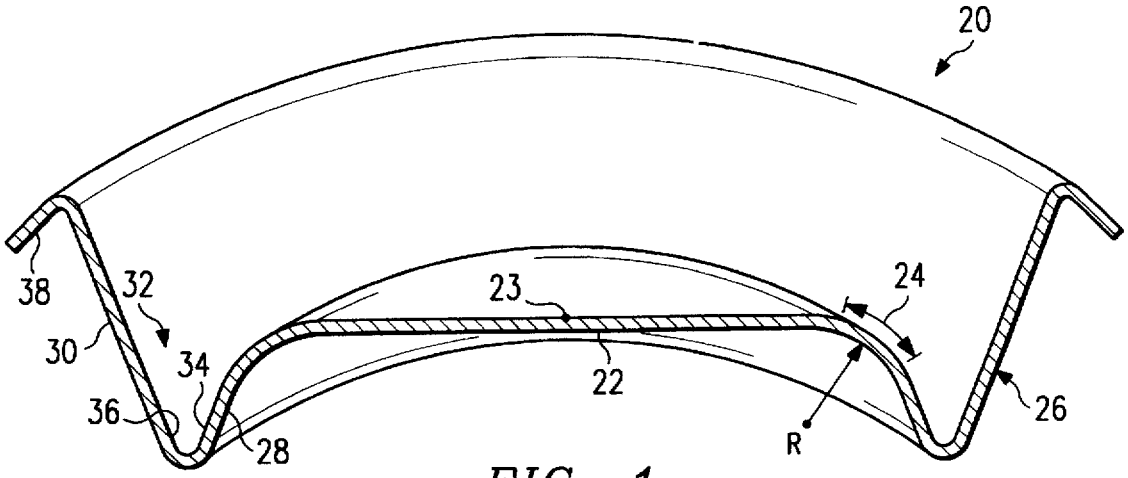
FIG. 1 (PRIOR ART)
FIG. 1 is an enlarged vertical cross-sectional view of a conventional container lid.

FIG. 1 shows a cross-sectional view of a conventional container lid. Container lid 20 includes a center panel 22, an inner annular panel 24 and an outer annular panel 26.

The center panel 22 has a centrally located centerpoint 23, and the outer periphery of center panel 22 is joined to the inner periphery of inner annular panel 24. The outer periphery of inner annular panel 24 is joined to the inner periphery of outer annular panel 26. The outer annular panel 26 is shown generally and typically comprises a panel wall 28 and chuck wall 30 joined together by two curved portions 34 and 36 to form an annular groove 32. The panel wall 28 extends generally downwardly and outwardly from the inner annular panel 24, while the chuck wall extends generally upwardly and outwardly from its junction with the panel wall 28, where upward and downward are defined as the directions away from and toward, respectively, the interior of the container when the container end is incorporated into a finished container. The curved portion 34 is also called a lower panel radius, while the curved portion 36 is also called a chuck wall radius. The annular groove 32 is sometimes referred to as the countersink. The radius of curvature of the lower panel radius 34 and the radius of curvature of the chuck wall radius 36 are sometimes referred to collectively as the radius of curvature of the countersink. Extending outwardly from the outer periphery of the chuck wall 30 is an annular seaming panel 38.

Inner annular panel 24 is located between and joined to each of the center panel 22 and the outer annular panel 26. The inner annular panel 24 has an arcuate shaped cross section as viewed in a radial plane through the centerpoint 23 of the center panel 22, with this arcuate shaped cross section having a radius of curvature R. The inner annular panel 24 is sometimes referred to as the upper panel radius or merely the panel radius. In a conventional container lid, the radius of curvature R for the inner annular panel 24 is uniform throughout the circumference of the inner annular panel 24. Similarly, each of the radius of curvature for the lower panel radius 34 and the radius of curvature for the chuck wall radius 36 is uniform throughout the circumference of the outer annular panel 26.

Figure 2:
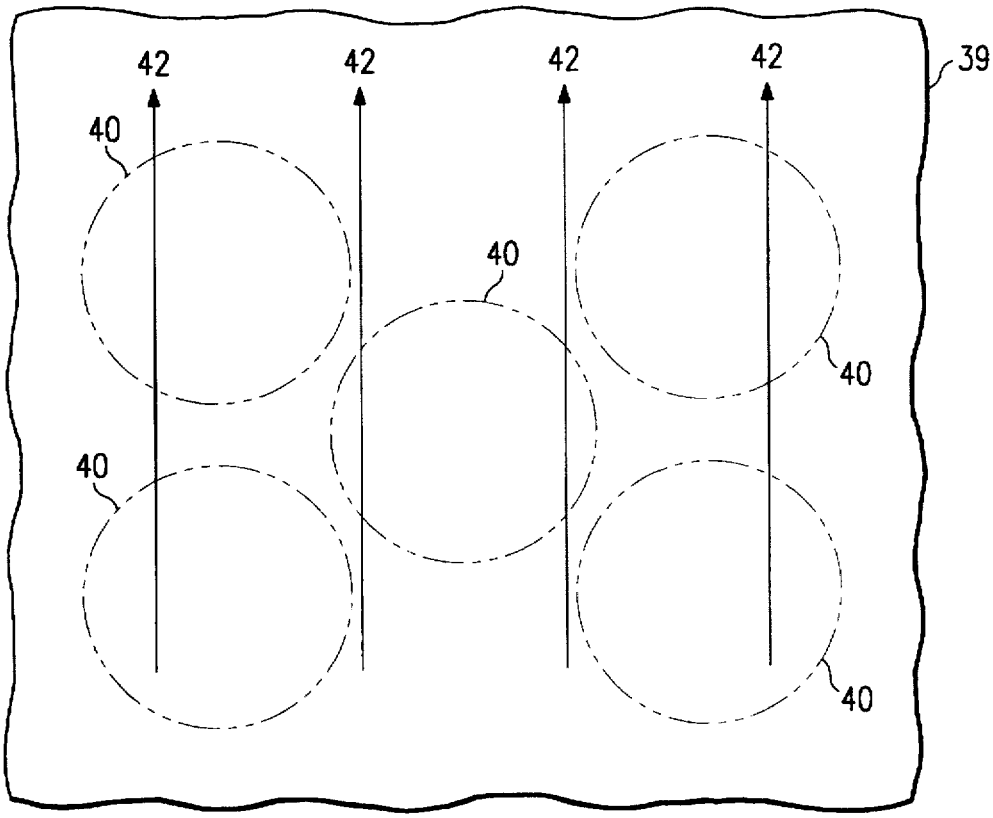
FIG. 2 is a top view of a portion of a sheet of metal containing a plurality of lid blanks.

With reference to FIG. 2, a top view of a portion of a sheet of metal 39 is illustrated as containing a plurality of metal lid blanks 40. The metal sheet 39 has been formed by the sheet manufacturer by rolling the metal in a rolling direction 42. Each of the metal lid blanks 40 is cut from the rolled sheet material 39 in a blanking operation to produce a plurality of circular metal lid blanks each having a rolling direction 42. Each circular metal lid blank can then be drawn or formed to produce a container lid 20. A blank can be cut and a container lid drawn or formed in a one step operation or in a multi-step operation.

While the formation in the lid of an annular groove having a small uniform radius of curvature increased the structural strength of the lids, the small radius of curvature resulted in an increased likelihood of fracturing occurring in the lid along the periphery of the annular groove.

In analyzing the process of cutting out the metal blanks, and forming and testing the lids, it was determined that the metal of a lid is strained to the point of fracture at the inner annular panel 24 and panel wall 28 at locations which are substantially perpendicular to the rolling direction of the metal (i.e., in a transverse direction about ±90°), referenced from the centerpoint of the lid. It was also determined that failure at the inner annular panel and panel wall due to buckling (the metal has less structural strength at these locations) occurs at locations which are about intermediate the rolling direction and the transverse direction, referenced from the centerpoint of the lid.

With knowledge of the locations on the lid which have less structural strength, a small radius of curvature can be employed in these locations to strengthen the lid. Additionally, with knowledge of the locations on the lid which are more susceptible to fracturing, a larger radius of curvature can be used in such locations to reduce the likelihood of fracturing. Since only the locations having less structural strength require a smaller radius of curvature for increased strength, the other locations around the circumference of the lid can have a slightly larger than normal radius of curvature, thus avoiding the increased likelihood of fracturing which would result if the radius of curvature was reduced uniformly about the circumference of the inner annular panel.

Figure 3:
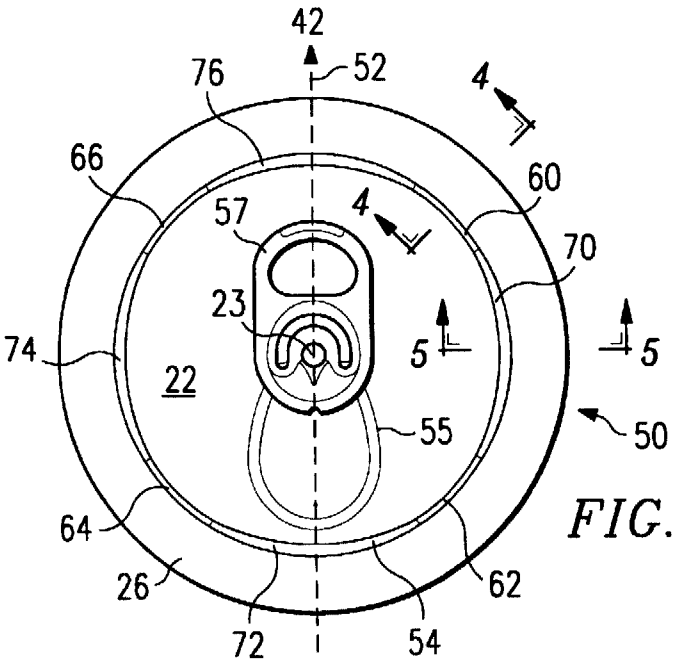
FIG. 3 is a top view of one embodiment of a container lid in accordance with the invention, showing the areas where the radius of curvature is small and the areas where the radius of curvature is large.

With reference to FIG. 3, a top view of a container lid 50 embodying the present invention is illustrated. While the specific embodiment of the container end of the present invention is illustrated as a container lid, aspects of the present invention can be utilized as well in container bottoms. Components of the lid 50 which are the same as for the lid 20 are designated with the same reference characters, and a detailed description thereof is not repeated. The reference line 52 is parallel to the rolling direction 42 of the sheet material 39 of the lid blanks 40 used to form the container lid 50. The reference line 52 intersects the centerpoint 23 of container lid 50. Container lid 50 is shown with the center panel 22 and the outer annular panel 26. However, the inner annular panel 24 has been replaced by a new inner annular panel 54. Additionally, the container lid 50 is shown with a weakened line of severance 55 in lid 50 and a pop-tab 57 attached or riveted on top of lid 50.

The inner annular panel 54 comprises a plurality of first segments, spaced apart along the circumference of the inner annular panel 54, and a plurality of second segments spaced apart along the circumference of the inner annular panel 54 with at least one second segment being positioned between each adjacent pair of first segments. Each segment is defined by two radii extending from the centerpoint 23 through the inner annular panel 54. The segments can be of the same circumferential length, i.e., encompassed by equal sector angles, or of different circumferential lengths, i.e. encompassed by different and unequal sector angles. The number of the first segments and the number of the second segments can vary from one design of a container lid to another design of a container or from one size to another size of container lid.

In the embodiment of the invention shown in FIG. 3, inner annular panel 54 comprises four first segments identified as 60, 62, 64, and 66, and four second segments identified as 70, 72, 74, and 76. Each of the first segments 60, 62, 64, and 66 has a first end connected to an adjacent second segment and a second end connected to another adjacent second segment. For example, a first end of first segment 60 is connected to an end of second segment 76, while a second end of first segment 60 is connected to an end of second segment 70.

Figure 6:
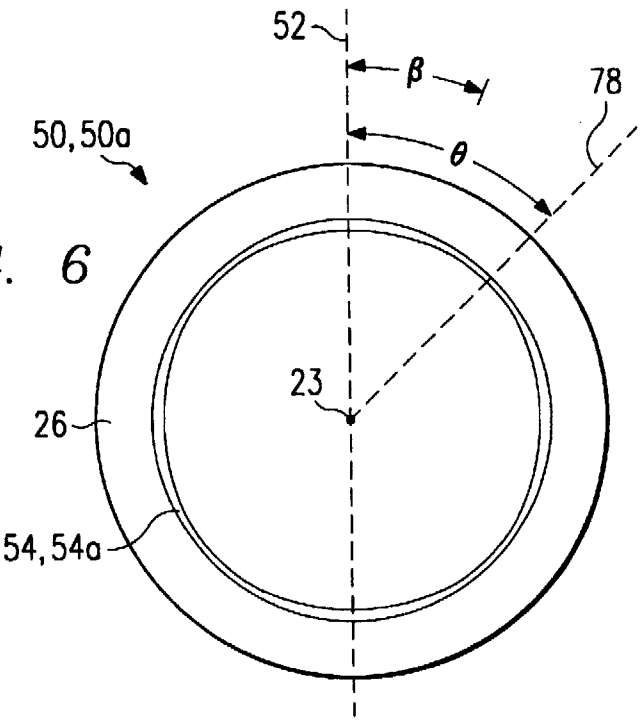
FIG. 6 is a top view of a container lid with a first line representing the rolling direction and a second line at an angle from the rolling direction.

The radius of curvature R1 of each of first segments 60, 62, 64, and 66 in the inner annular panel 54 is smaller than the radius of curvature R2 of the second segments 70, 72, 74, and 76 in the inner annular panel 54. The location of each of the first segments 60, 62, 64, and 66 in the inner annular panel 54 can be identified by referring to reference line 52 and lid centerpoint 23. As shown in FIG. 6, the center of each of the first segments 60, 62, 64, and 66 is located in inner annular panel 54 at an angle±Θ defined by a line 78 extending through the lid centerpoint 23 and the center of the respective first segment and either the leading portion or the trailing portion of reference line 52, where leading and trailing portions are defined as the line portions extending from the centerpoint 23 in the same direction as, and opposite to, respectively, the rolling direction 42. In general, the absolute value of each Θ is in the range of about 30° to about 65°. Thus, the center of first segment 60 is located at an angle Θ in the range of about 30° to about 65° viewed in a clockwise direction from the leading portion of reference line 52; the center of first segment 62 is located at an angle Θ in the range of about 30° to about 65° viewed in a counterclockwise direction from the trailing portion of reference line 52; the center of first segment 64 is located at an angle Θ in the range of about 30° to about 65° viewed in a clockwise direction from the trailing portion of reference line 52; and the center of first segment 66 is located at an angle Θ in the range of about 30° to about 65° viewed in a counterclockwise direction from the leading portion of reference line 52. Preferably, the absolute value of each Θ will be in the range of about 40° to about 55°, with an absolute value of approximately 48° having been found to be advantageous in a preferred embodiment of the invention having four first segments and four second segments.

The arcuate lengths of the segments of the inner annular panel 54 can be measured in degrees, with the entire circumferential length of inner annular panel 54 totalling 360 degrees. The arcuate length of each of the first segments will depend upon the number of first segments. With four first segments, the arcuate length of each of the four first segments 60, 62, 64, and 66 will typically be less than about 70°, and more preferably less than about 40°, and most preferably less than about 30°. When shorter arcuate lengths for the first segments are employed, the number of first segments can be increased. Thus, the cumulative length of the first segments, expressed as the sum of the lengths of the individual first segments, will typically be less than 280°, preferably less than about 160°, and most preferably less than about 100°.

Figure 5:
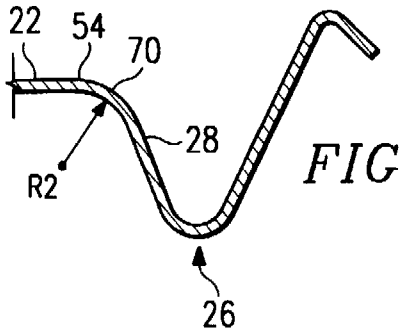
FIG. 5 is a fragmentary cross sectional view along line 5—5 showing a portion of the container lid having a larger radius of curvature in the inner annular panel.
Figure 4:
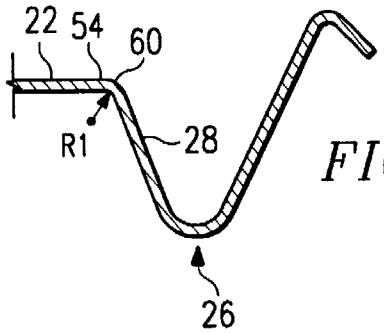
FIG. 4 is a fragmentary cross sectional view along line 4—4 showing a portion of the container lid having a smaller radius of curvature in the inner annular panel.

As mentioned earlier, the radius of curvature R1 of each of the first segments 60, 62, 64, and 66 is less than the radius of curvature R2 of each of the second segments 70, 72, 74, and 76. Thus, the radius of curvature R1 for the first segment 60 of the inner annular panel 54, as shown in FIG. 4, is substantially less than the radius of curvature R2 for the second segment 70 of the inner annular panel 54, as shown in FIG. 5. Each of the first and/or second segments can have minor variations in the radius of curvature along the respective segment.

The radius of curvature R1 corresponds to the radius of curvature of each of first segments 60, 62, 64, and 66, while the radius of curvature R2 corresponds to the radius of curvature of each of second segments 70, 72, 74, and 76. The radius of curvature R1 of the first segments is typically in the range of about 0.010 inch and about 0.025 inch, while the radius of curvature R2 of the second segments is typically in the range of about 0.015 inch and about 0.035 inch. Preferably, the radius of curvature R1 is in the range of about 0.012 inch to about 0.025 inch, while the radius of curvature R2 is in the range of about 0.017 inch to about 0.030 inch. More preferably, the radius of curvature R1 is approximately 0.015 inch, while the radius of curvature R2 is approximately 0.025 inch. The radius of curvature R1 is substantially less than the radius of curvature R2. Typically the difference between the radius of curvature R1 of the first segments and the radius of curvature R2 of the second segments is at least about 0.003 inch, and preferably at least about 0.006 inch. More preferably, this difference will be in the range between about 0.003 inch and about 0.015 inch, and most preferably is about 0.01 inch.

Measurement of the radius of curvature of the inner annular panel can be accomplished by different methods known in the art. On particular method of measuring the radius of curvature uses what is known as a comparator. A comparator projects a blown-up view of the cross-section of the sample to be measured. A template having many different radii of curvature is then used to measure the radius of curvature of the blown-up view of the cross-section. Other methods of measurement are readily known in the art and can also be found in many metallurgical catalogs.

Figure 7:
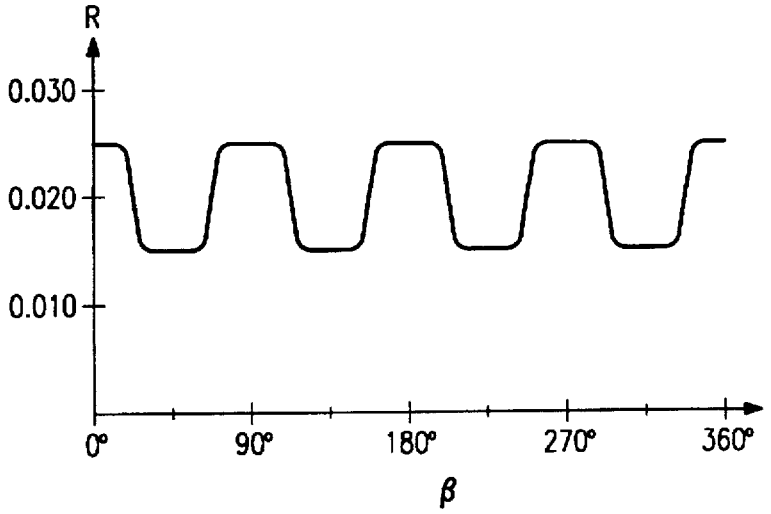
FIG. 7 is a graph relating to one embodiment of the present invention showing the size of the radius of curvature R of the inner annular panel with respect to the angle from the rolling direction.

FIG. 6 shows a top view of the container lid 50 showing the angle β with respect to the leading portion of the reference line 52. FIG. 7 shows a graph of the variations in the size of the radius of curvature R of inner annular panel 54 with respect to the value of angle β. The vertical axis of the graph show values in inches of the radius of curvature R of inner annular panel 54, while the horizontal axis of the graph shows the angle β in degrees measured clockwise from the leading portion of the reference line 52. While the change in size of the radius of curvature from R1 to R2 (or R2 to R1) can be substantially represented by a step function, the change in the radius size will commonly constitute a more gradual change than a step function. This may result in inner annular panel 54 or **54*a*** having transitionary segments interconnected between the first segments and second segments. Such transitionary segments can have a radius of curvature R which increases at one end from R1 of a first segment to R2 of a second segment at the other end (or decreases from R2 of a second segment to R1 of a first segment). This rate of increase or decrease in the radius of curvature R along such a transitionary segment may be large or may be relatively gradual.

Figure 8:
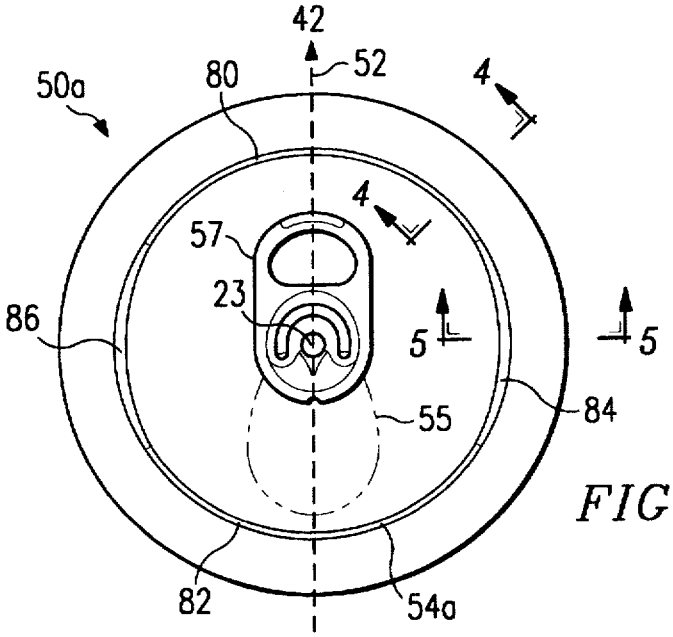
FIG. 8 is a top view of the preferred embodiment of a container lid in accordance with the invention, showing the areas where the radius of curvature is large and the areas where the radius of curvature is small.

The preferred embodiment of the present invention is shown in FIG. 8. Inner annular panel **54*a* comprises two first segments identified as 80 and 82, and two second segments identified as 84 and 86. Each of first segments 80 and 82** has a first end connected to an adjacent second segment and a second end connected to another adjacent second segment.

The radius of curvature R1 of each of the first segments 80 and 82 in the inner annular panel 54*a* is smaller than the radius of curvature R2 of the second segments 84 and 86 in the inner annular panel 54. The location of each of the second segments 84, 86 can also be identified by referring to reference line 52 and lid centerpoint 23. The center of each of the second segments 84 and 86 is located in inner annular panel 54*a* at an angle±Θ defined by a line 78 extending through the lid centerpoint 23 and the center of the respective second segment and either the leading portion or the trailing portion of reference line 52, as shown in FIG. 6. In general, the absolute value of each Θ is in the range of about 70° to about 110°. Thus, the center of the second segment 84 is located at an angle Θ in the range of about 70° to about 110° viewed in a clockwise direction from the leading portion of reference line 52; the center of the second segment 86 is located at an angle Θ in the range of about 70° to about 110° viewed in a counter clockwise direction from the leading portion of reference line 52. Preferably, the absolute value of each Θ will be in the range of about 85° to about 95°, with an absolute value of approximately 90° having found to be advantageous in a preferred embodiment of the invention having two first segments 80, 82 and two second segments 84, 86.

The arcuate length of each of the second segments 84, 86 will depend on the number of second segments. The arcuate length of each of the two second segments 84 and 86 will typically be less than about 60°, preferably less than about 40°, more preferably less than about 30°, and most preferred in the range of about 5° and about 30°. When shorter arcuate lengths for the second segments are employed, the number of second segments can be increased. The cumulative length of the second segments will typically be less than about 120°, and preferably less than about 60°.

The radius of curvature R2 of each of the second segments 84 and 86 is greater than the radius of curvature R1 of each of the first segments 80 and 82. The typical and preferred ranges of values for R1 and R2 for this embodiment are set forth above in the description of the other embodiment described above.

Figure 9:
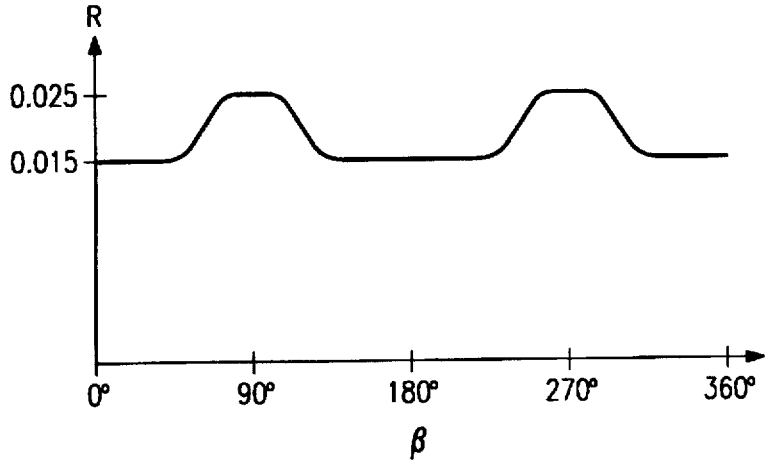
FIG. 9 is a graph relating to the preferred embodiment of the present invention showing the size of the radius of curvature R of the inner annular panel with respect to the angle from the rolling direction.

FIG. 9 is a graph for the embodiment of FIG. 8, similar to the graph shown in FIG. 7 for the embodiment illustrated in FIG. 3, showing variations in the size of the radius of curvature R of inner annular panel 54 with respect to the value of angle β of FIG. 6.

Another embodiment of a container lid contemplated by the present invention is shown in FIG. 10A. Container lid 120 includes a center panel 122, an inner annular panel 124 and an outer annular panel 126. In this embodiment, center panel 122 is defined to include an annular portion 128. The center panel 122 has a centerpoint 123, and the outer periphery of center panel 122, defined as annular portion 128, is joined to the inner periphery of inner annular panel 124. The outer periphery of inner annular panel 124 is joined to the inner periphery of outer annular panel 126. Outer annular panel 126 is shown generally and typically comprises a chuck wall 130. Extending outwardly from the outer periphery of chuck wall 130 is seaming panel 138. Inner annular panel 124 comprises two curved portions 134 and 136 to form annular groove 132. The cross-section of inner annular panel 124 can have a single radius of curvature R, as shown in FIG. 10B, or it can comprise two radially spaced annular portions extending completely around the circumference of container lid 120 with the cross-section of each of the two radially spaced annular portions having a radius of curvature R' and R", as shown in FIG. 10C, corresponding to the two different annular curved portions 134 and 136. In other words, inner annular panel 124 can comprise one 360° annular band having a radius of curvature R, or it can comprise two radially spaced 360° annular bands with one of the annular bands having a radius of curvature R' and the other annular band having a radius of curvature R". This is illustrated in FIGS. 10B and 10C where fragmentary cross-sectional views of container lid 120 are shown.

Similar to the variable radius of curvature R along inner annular panel 54 of the prior embodiment, inner annular panel 124 comprises a plurality of first segments having a radius of curvature R1, and a plurality of second segments having a radius of curvature R2, with R2 being greater than R1. When two radially spaced annular bands 134 and 136 are employed, at least one of the two annular bands has a plurality of first segments having a first radius of curvature and a plurality of second segments having a second radius of curvature with the second radius of curvature being greater than the first radius of curvature, so that the effective radius of curvature of annular panel 124 varies about the circumference thereof in the same manner as the radius of curvature of annular panel 54 or 54*a* varies about the circumference thereof.

With reference to FIG. 11, container 90 is shown comprising container lid 50 or container lid 120 joined to container body 92. Container body 92 can be one unitary piece or can be comprised of a number of separate pieces joined together.

FIG. 12 shows the steps for producing the container end of the present invention as part of the steps for producing a container using the container end of the present invention. In Step A, a metal lid blank 40, shown in FIG. 13A, having a generally circular shape is cut from the metal sheet material 39 having a rolling direction 42. In Step B, the metal lid blank 40 is drawn or formed to produce container lid 50 having an inner annular panel 54, 54*a* or 124 with a generally arcuate cross section where the radius of curvature of the inner annular panel is non-uniform or variable along the circumferential length of the inner annular panel. A weakened line of severance 55 is formed in the central panel 22 and a pop-tab 57 is attached to the central panel 22 in cooperative relationship with the weakened line of severance 55, to produce the container end 50 illustrated in FIG. 13B.

A unitary container body 92 can be accomplished in two steps. In step C, a metal body blank 96, illustrated in FIG. 13C, is cut from metal sheet material. This sheet material may or may not have a rolling direction. In Step D, the metal body blank 96 is drawn or formed to produce a unitary container body 92, illustrated in FIG. 13D.

In Step E, a container end 50 and a container body 92 are assembled to form pressure resistant container 90, illustrated in FIG. 13E. This can be accomplished by joining or seaming container end 50 to container body 92, in most cases after the container contents are added.

Various methods or techniques of cutting the metal lid blares and metal body blanks are well known in the art. Similarly, several methods or techniques exist for one of ordinary skill in the art to form a unitary container body from a metal body blank and to seam a container end to the container body to produce a container. The methods of the present invention provide for the making of a container end having the characteristics as disclosed, and further provide for the making of a pressure resistant container having such a container end.

Figure 15:
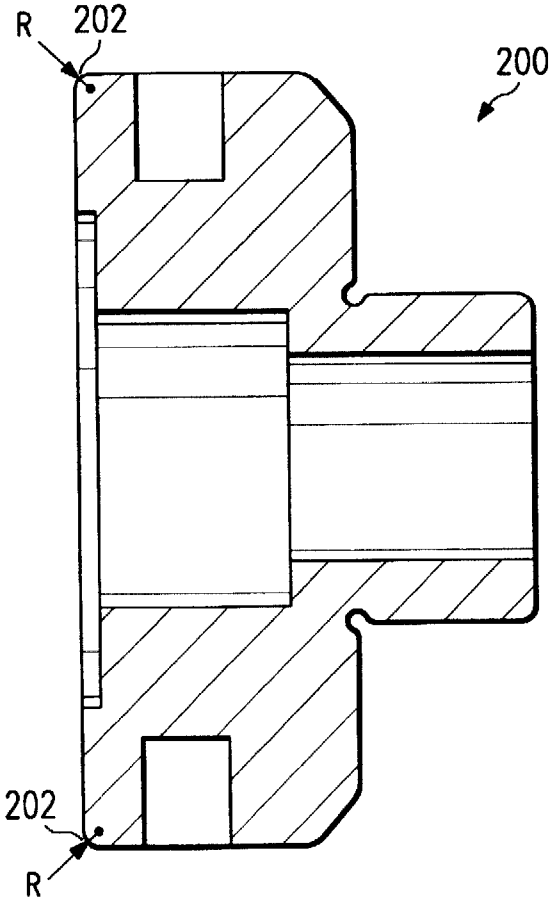
FIG. 15 (PRIOR ART)
FIG. 15 is a cross-sectional side view along line 15—15 of the die in FIG. 14.
Figure 14:
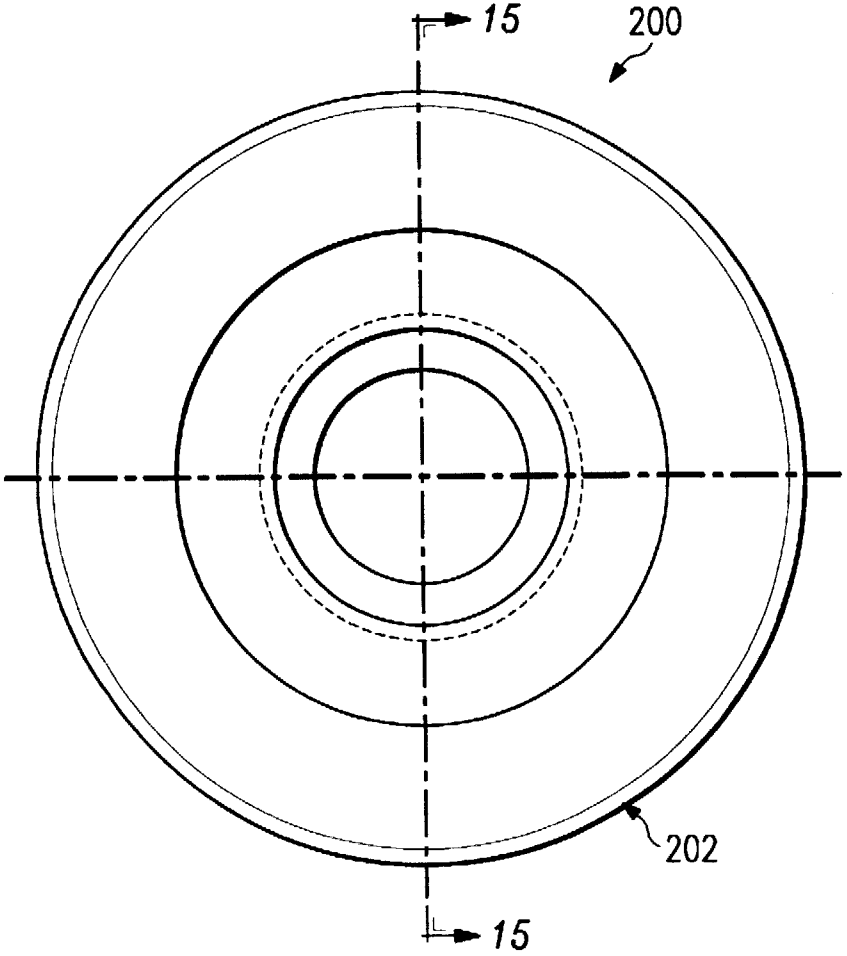
FIG. 14 (PRIOR ART)
FIG. 14 is a top view of a die used to make a conventional container lid.

Prior art container lid 20 was produced by using a die, such as die 200 shown in FIG. 14. Dies similar to die 200 are well known in the art. With reference to FIGS. 14 and 15, FIG. 14 is a top view of die 200 and FIG. 15 is a cross-sectional side view along line 15—15 of die 200. Die 200 has an outer annular edge 202 extending completely about the circumference of the die 200. Outer annular edge 202 has a generally arcuate cross section when viewed in a radial plane extending through the axis of die 200. This cross section has a radius of curvature R which is uniform or non-variable along the circumferential length of outer annular edge 202. When die 200 is pressed against a metal blank, portions of the metal blank bend around outer annular edge 202 which, in turn, forms the radius of curvature of the inner annular panel of the container lid. Since outer annular edge 202 of die 200 has a uniform or non-variable radius of curvature along its circumferential length, the container lid produced in conjunction with the use of die 200 has a corresponding inner annular panel with a uniform or non-variable radius of curvature along its circumferential length.

Figure 16:
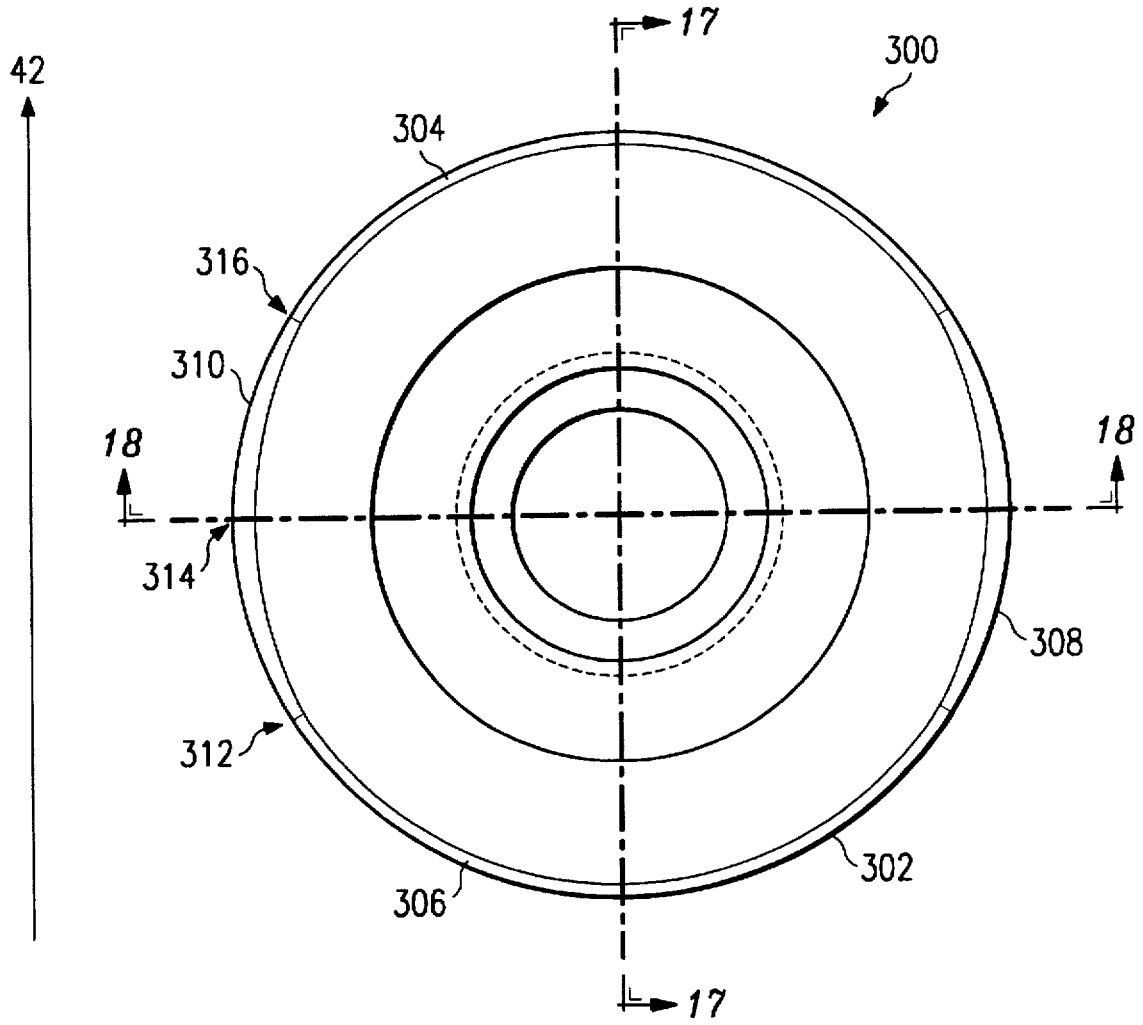
FIG. 16 a top view of one embodiment of a die in accordance with the invention showing the areas where the radius of curvature is small and the areas where the radius of curvature is large.
Figure 17:
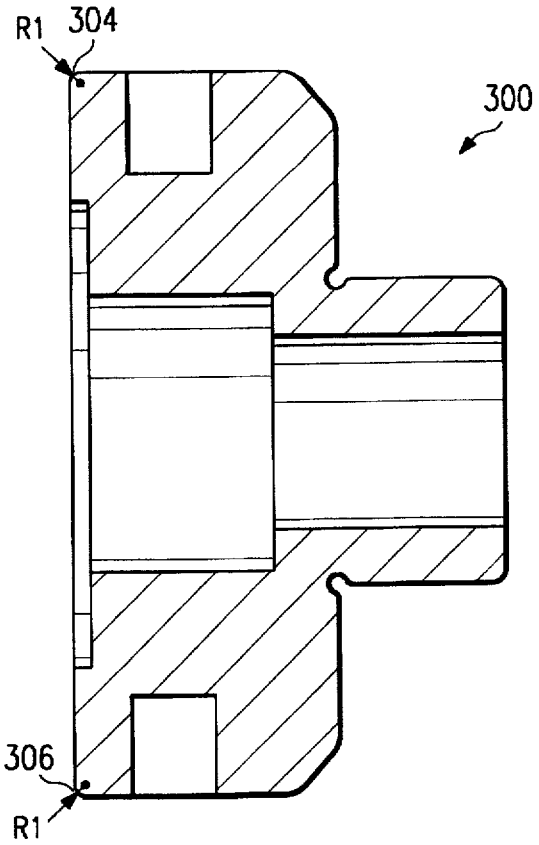
FIG. 17 is a cross-sectional side view along line 17—17 of the die in FIG. 16.
Figure 18:
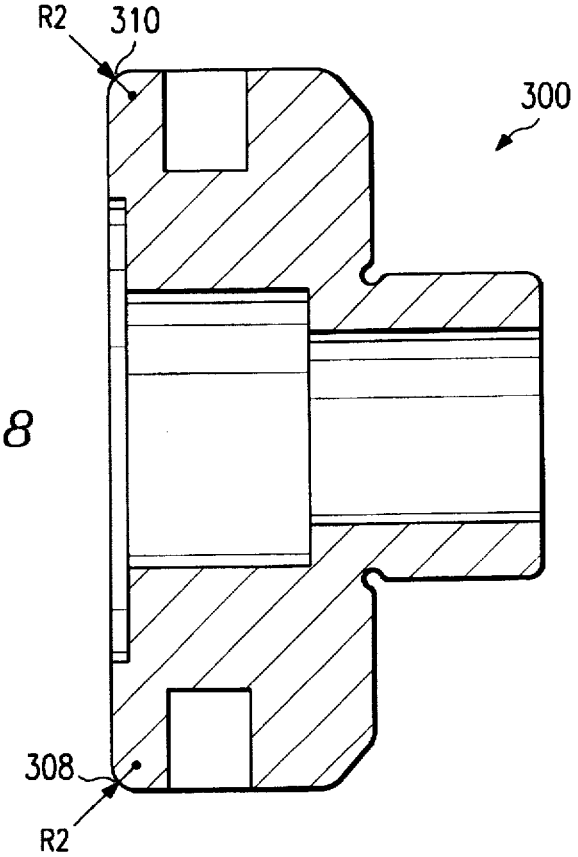
FIG. 18 is a cross-sectional side view along line 18—18 of the die in FIG. 16.

To produce the container lid of the present invention, a new and novel die is needed. With reference to FIGS. 16, 17 and 18, new die 300 is shown. FIG. 16 is a top view of die 300. FIGS. 17 and 18 are cross-sectional side views of die 300 along lines 17—17 and 18—18 respectively. As shown in FIG. 16, die 300 has an outer annular edge 302 extending completely about the circumference of the die 300. Outer annular edge 302 has a generally arcuate cross section when viewed in a radial plane extending through the axis of die 300. However, outer annular edge 302 comprises a plurality of first segments, spaced apart along the circumference of the outer annular edge 302, and a plurality of second segments spaced apart along the circumference of the outer annular edge 302 with at least one second segment being positioned between each adjacent pair of first segments. In the preferred embodiment, these first and second segments of the annular edge 302 correspond to the first and second segments of the inner annular panel 54*a* described in the disclosure of the new container lid 50*a* of the present invention. Additionally, these first and second segments of the annular edge 302 can correspond to the first and second segments of the inner annular panel 54 described in the disclosure of the new container lid 50 of the present invention.

In the preferred embodiment of the present invention, outer annular edge 302 comprises two first segments identified as 304 and 306, and two second segments identified as 308 and 310. Each of first segments 304 and 306 has a first end connected to an adjacent second segment and a second end connected to another adjacent second segment. The orientation of die 300 is shown with respect to the rolling direction 42 of a metal blank which will eventually be formed into a finished container lid.

With reference to FIGS. 17 and 18, two cross-sectional side views of die 300 are shown, one along line 17—17 and another along line 18—18.

The radius of curvature R1 corresponds to the radius of curvature of each of first segments 304 and 306, while the radius of curvature R2 corresponds to the radius of curvature of each of the second segments 308 and 310, with each of these radii of curvature further corresponding to the radii of curvature for the new container lid of the present invention as disclosed previously. Similarly, the values, ranges and differentials given for the radii of curvature R1 and R2 of the inner annular panel of the new container lid are the same for the R1 and R2 for the outer annular panel 302 of die 300. The transition from segments having a radius of curvature R1 to segments having radius of curvature R2, and vice versa, is preferably gradual. That is, the radius of curvature R1 gradually increases to radius of curvature R2, along the circumferential length of outer annular edge 302, and vice versa.

There are numerous methods or techniques for producing die 300. The preferred method of producing die 300 is to modify existing die 200. Die 200 has outer annular edge 202 having a uniform radius of curvature along its circumferential length. In the preferred method, die 200 has a radius of curvature of R, which is about 0.015 inch. Next, a cutting tool having a radius of curvature R2 is used. Preferably, R2 is about 0.025 inch. The cutting tool is used to enlarge the radius of curvature along the desired segment from R1 to R2. As disclosed earlier, it is preferable to gradually increase the radius of curvature from R1 to R2. This is done by blending the cutting tool into the outer annular edge 302. This is shown in FIG. 16 where the radius of curvature at about point 312 is about R1. Traveling in a clockwise direction along the outer annular edge 302 from point 312, the radius of curvature gradually increases from about R1 to about R2 near point 314. Traveling clockwise from point 314, the radius of curvature gradually decreases from about R2 to about R1 near point 316.

New die 300 is employed with other devices and steps well known in the art to eventually produce the new container lid of the present invention. Thus, the present invention is a new die to be used in a new method to produce a new container end having the characteristics and attributes described above.

A major advantage of the present invention is that the entire container end material can be made from a thinner sheet of metal than before. Increasing the radius of curvature at locations where the container end is more susceptible to cracking due to the rolling direction allows the end to be constructed with thinner sheet material.

What is claimed is:

1. A method, comprising the steps of:

(a) cutting a metal blank from a rolled sheet of metal having a stock thickness and a rolling direction; and (b) forming said metal blank into a container end comprising a center panel having a centerpoint and an outer periphery, an outer annular panel having an inner periphery, and an inner annular panel having an inner periphery and an outer periphery, and a generally uniform thickness substantially equal to the stock thickness of the sheet metal, the inner periphery of said inner annular panel being joined to the outer periphery of said central panel, the outer periphery of said inner annular panel being joined to the inner periphery of said outer annular panel; said inner annular panel having a generally arcuate cross section, viewed along a radial plane from the centerpoint of said central panel; said inner annular panel comprising:

(i) a plurality of first segments about the circumferential length of said inner annular panel, and (ii) a plurality of second segments, with at least one first segment being positioned between each adjacent pair of second segments, the generally arcuate cross section of each of said first segments having a radius of curvature, viewed in radial cross section, which is substantially less than the radius of curvature, viewed in radial cross section, of the generally arcuate cross section of each of said second segments, the radius of curvature on the upward-facing surface of any said segment being substantially equal to the radius of curvature for the through-adjacent downward-facing surface to equally space said upward-facing surface and said downward-facing surface from one another throughout said segment.

2. The method of claim 1, wherein each second segment is positioned about said inner annular panel so that the center of the respective first segment, when viewed from the centerpoint of the central panel, is located in said inner annular panel at an angle which is in the range of about 70° to about 110° in either direction from a line parallel to the rolling direction of the rolled sheet material used to form the container end, said line extending through the centerpoint of the central panel.

3. The method of claim 2 wherein the difference between the radius of curvature of each of said plurality of first segments and the radius of curvature of each of said plurality of second segments is at least about 0.003 inch.

4. The method of claim 2 wherein the radius of curvature of each of said plurality of first segments is in the range of about 0.012 inch to about 0.025 inch, the radius of curvature of each of said plurality of second segments is in the range of about 0.017 inch to about 0.03 inch, and the difference between the radius of curvature of each of said plurality of first segments and the radius of curvature of each of said plurality of second segments is at least about 0.003 inch.

5. The method of claim 2 wherein the radius of curvature of each of said plurality of first segments about 0.015 inch and the radius of curvature of each of said plurality of second segments is about 0.025 inch.

6. The method of claim 2 further comprising the steps of:

(c) providing a container body; and (d) forming a pressure resistant container by seaming said container end to said container body.

7. The method of claim 6 wherein the radius of curvature of each of said plurality of first segments is in the range of about 0.012 inch to about 0.025 inch, the radius of curvature of each of said plurality of second segments is in the range of about 0.017 inch to about 0.03 inch, and the difference between the radius of curvature of each of said plurality of first segments and the radius of curvature of each of said plurality of second segments is at least about 0.003 inch.

8. A die for forming different radii of curvature of a generally arcuate cross section along the circumferential length of an inner annular panel of a container end, the die comprising:

(a) an outer annular edge having a generally arcuate cross section, said outer annular edge comprising, (i) a plurality of first segments spaced apart about the circumferential length of said outer annular edge, and (ii) a plurality of second segments, with at least one first segment being positioned between each adjacent pair of second segments, the generally arcuate cross section of each of said first segments having a radius of curvature, viewed in radial cross section, which is substantially less than the radius of curvature, viewed in radial cross section, of the generally arcuate cross section of each of said second segments.

9. The die of claim 8 wherein the radius of curvature, viewed in radial cross section, of each of said plurality of first segments is in the range of about 0.01 inch to about 0.025 inch, while the radius of curvature, viewed in radial cross section, of each of said plurality of second segments is in the range of about 0.015 inch to about 0.035 inch.

10. The die of claim 8 wherein the radius of curvature, viewed in radial cross section, of each of said plurality of first segments is in the range of about 0.012 inch to about 0.025 inch, the radius of curvature of each of said plurality of second segments, viewed in cross section, is in the range of about 0.017 inch to about 0.03 inch, and the difference between the radius of curvature of each of said plurality of first segments and the radius of curvature of each of said plurality of second segments is at least about 0.003 inch.

11. The die of claim 8 wherein the radius of curvature, viewed in cross section section, of each of said plurality of first segments is about 0.015 inch and the radius of curvature, viewed in cross section, of each of said plurality of second segments is about 0.025 inch.

12. A die for forming, from a rolled sheet of metal having a rolling direction, a container end having different radii of curvature of a generally arcuate cross section along the circumferential length of an inner annular panel at locations oriented with respect to said rolling direction, the die comprising:

(a) a die body having an outer annular edge and being orientatable with respect to the rolling direction of a rolled sheet of metal;

(b) said outer annular edge having a generally arcuate cross section and including:

(i) a plurality of first segments spaced apart about the circumferential length of said outer annular edge, and (ii) a plurality of second segments, with at least one said first segment being positioned between each adjacent pair of said second segments, the generally arcuate cross section of each of said first segments having a radius of curvature, viewed in radial cross section, which is substantially less than the radius of curvature, viewed in radial cross section, of the generally arcuate cross section of each of said second segments; and (c) said first and second segments being positioned on said outer annular edge of said die body in relation to the orientation of said die body with respect to the rolling direction of said rolled sheet of metal.

13. A die for forming a container end according to claim 12, wherein the difference between the radius of curvature, viewed in cross section, of each of said plurality of first segments and the radius of curvature, viewed in cross section, of each of said plurality of second segments, is within the range of about 0.003 to 0.015 inch.

14. A die for forming a container end according to claim 12, wherein the center of each respective second segment is oriented on said outer annular edge of said die body at an angular orientation within the range of about 70 to 110 degrees in either direction with respect to said rolling direction of said sheet of metal.

15. A die for forming a container end according to claim 12, wherein a transition section is positioned between each said first and second segment;

said transition section having a radius of curvature, viewed in cross section, having a range of values;

said range of values for said radius of curvature of said transition section changing smoothly from a maximum value equal to the radius of curvature of said adjacent second segment to a minimum value equal to said radius of curvature of said adjacent first segment.

* * * * *